United States Patent [19]

Filho et al.

[11] Patent Number: 4,707,275

[45] Date of Patent: Nov. 17, 1987

[54] PROCESS FOR SEPARATING WATER AND SOLIDS FROM FUELS

[75] Inventors: Jorge H. Filho; Dorian L. Bachmann, both of Sao Mateus do Sul, Brazil

[73] Assignee: Petroleo Brasileiro SA-Petrobras, Rio de Janeiro, Brazil

[21] Appl. No.: 909,067

[22] Filed: Sep. 17, 1986

[30] Foreign Application Priority Data

Sep. 20, 1985 [BR] Brazil ..... 8504611

[51] Int. Cl.[4] ..... B01D 21/26

[52] U.S. Cl. ..... 210/787; 210/806; 208/425

[58] Field of Search ..... 210/634, 768, 787, 800, 210/806, 804, 805; 208/424, 425, 177

[56] References Cited

U.S. PATENT DOCUMENTS

| | | | |
|---|---|---|---|
| 4,162,965 | 7/1979 | Clapper | 208/177 |
| 4,348,288 | 9/1982 | Yoshinaga et al. | 210/708 |
| 4,415,430 | 11/1983 | York | 210/806 |
| 4,473,461 | 9/1984 | Thacker et al. | 210/806 |

FOREIGN PATENT DOCUMENTS

| | | | |
|---|---|---|---|
| 1094484 | 1/1981 | Canada | 208/425 |

*Primary Examiner*—Peter Hruskoci
*Assistant Examiner*—Coreen Y. Lee
*Attorney, Agent, or Firm*—Blum Kaplan

[57] ABSTRACT

A process for treating a fuel oil feedstock that is contaminated with water and a large amount of small particles is provided. Centrifugal separators, mixing tanks and filter presses are used in accordance with a two step separation scheme that permits recovery of a final reject that can be directly disposed of and a treated oil that can be utilized directly as a fuel or that can undergo further treatment is obtained.

13 Claims, 1 Drawing Figure

PROCESS FOR SEPARATING WATER AND SOLIDS FROM FUELS

BACKGROUND OF THE INVENTION

This invention relates to a process for treating a feedstock obtained from a retort process and, in particular, to a process for separating water and solids from shale oil feedstock obtained from a shale retort process.

Oil feedstocks produced by retort processes and in particular, shale retort processes, generally contain a large amount of water and insoluble solids. In most cases, it is difficult to remove the water and insoluble solids from the feedstock to a sufficient extent to permit recovery and use of the oil. It is particularly desirable to recover oil of sufficient purity to allow the recovered oil to be used as a fuel.

Specifically, in the case of shale oil obtained from a shale retort process, shale fines become entrained in the oil and are difficult to separate. The present invention is particularly suitable for separating shale fines from shale oil.

A shale retort process is disclosed in Brazilian Pat. No. PI 7105857. According to the process disclosed, hydrocarbon containing solids are continuously fed at the top of a vertical retort. The solids are evenly distributed to the retort zone and then proceed downwards to a cooling zone, located below the retort zone. Retorting is carried out at superatmospheric pressure as follows:

1. Recycled gases that had previously and indirectly been heated from an external source and which are substantially devoid of free oxygen are introduced through the bottom of the retort zone at the retorting temperature; and, 2. Recycled gases which are substantially devoid of free oxygen are introduced cold into the bottom of the cooling zone. The cold recycled gases travel upward and exchange heat with the solid retorted material. The solid retorted material is continuously removed through the bottom of the retort zone and the retort products are removed from the top of the zone. The retort products consist primarily of oil in the form of mist and gas. In the process, it is essential to provide direct contact between the gas and the solids in order to achieve proper retort operation. The gaseous effluents carry the oil extracted from the shale out of the retort. In addition, undesirable amounts of dust are extracted from the shale by the gaseous effluents.

Attempts to reduce the volume of fines entrained with the oil by pretreatment of the retort feed generally are inadequate. Shale fine generation occurs during the retort process itself. These fines are not fully retained in the cyclones and precipitators. Accordingly, the oil obtained from prior art processes has an unacceptable water and solids content for conventional use as a fuel.

Many papers have been published suggesting a wide variety of solutions to the problem of fines entrained with oil. Some authors suggest the use of chemical additives capable of picking up the solid particles in a non-oil phase. Phase separation methods are also suggested. U.S..Pat. No. 3,929,625 teaches the use of a chemical additive that is capable of forming a dispersion with the oil. The dispersion is then subjected to an electric field to break it up.

Other processes are based on solvent extract methods combined with settling, filtration and/or distillation steps and the like. Examples of such methods are shown in U.S. Pat. Nos. 4,094,781 and 4,162,965. Another exemplary method is shown in Canadian Pat. No. 1,094,484 and other methods are also known. However, all of these prior art methods are less than completely satisfactory.

Accordingly, it is desirable to provide a satisfactory process for separating water and insoluble solids from a fuel oil feedstock.

SUMMARY OF THE INVENTION

General speaking, in accordance with the invention, a process for the treatment of a fuel oil that is contaminated with water and a large amount of small particles is provided. A fuel stream containing water and significant amounts of small particle size solids is fed to a first separating step to yield a first recovered fuel stream and an oil cake; subjected to a second separating step to yield a clean fuel stream, an oil-bearing water stream and a sludge stream; the oil-bearing stream is treated in a separator to recover the oil; the sludge stream is concentrated to yield a cake which is treated in a first separating step with a solvent to yield a suspension which is fed to a filter-press; the first recovered oil stream from the first separation step is blended with the supernatant oil separated from the concentration sludge filtrate to form a semi-cleaned fuel stream to be subjected to the second separating step. The rejected fraction can be disposed of directly and the treated fuel oil can be employed directly as a fuel or can undergo further processing.

Accordingly, it is an object of the invention to provide an improved process for separating water and solids from fuels.

It is another object of the invention to provide a process for treating a fuel oil feedstock in order to decrease the impurity content to a level that is acceptable for conventional consumption of the fuel oil.

A further object of the invention is to provide a process for treating a synthetic fuel oil feedstock.

Yet another object of the invention is to provide a process for obtaining tailings with an economically and environmentally acceptable oil content.

Still another object of the invention is to treat a shale oil feedstock containing shale fines and/or water in order to decrease the content of the shale fines and the water and to permit use of the oil as a fuel.

Still other objects and advantages of the invention will in part be obvious and will in part be apparent from the specification.

The invention accordingly comprises the several steps and the relation of one or more of such steps with respect to each of the others thereof, which will be exemplified in the process hereinafter disclosed, and the scope of the invention will be indicated in the claims.

DESCRIPTION OF THE DRAWINGS

For a fuller understanding of the invention, reference is had to the following description taken in connection with the accompanying drawing, in which.

DETAILED DESCRIPTION OF THE INVENTION

Figure 1:
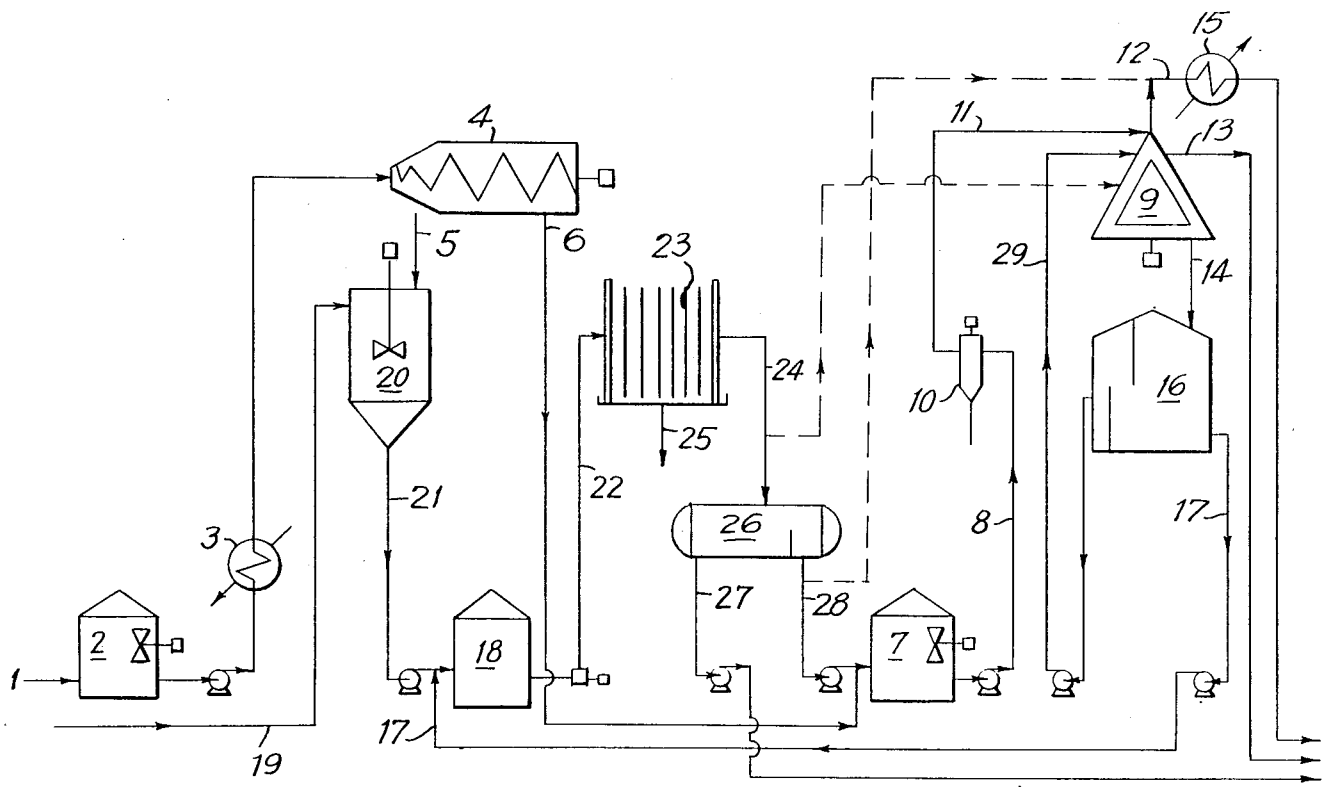
FIG. 1 is a flow diagram showing the process of removing solids and water from fuels in accordance with the invention.

A fuel oil feedstock stream containing water and a large amount of small particles is subjected to a first separating step in order to obtain a first recovered fuel stream and an oil cake. The first recovered fuel stream, which is semi-cleaned, still contains solids and water and is subjected to a second separating step in order to obtain a clean fuel stream, an oil-bearing water stream and a sludge stream. The oil-bearing water stream is treated in a separator in order to recover the oil. The oil cake obtained in the first separating step is treated with a solvent optionally selected from a lighter fraction of the oil in order to obtain a suspension. The suspension is admixed with the sludge stream and fed to a filter-press and this yields a filtrate and the final reject. The filtrate is decanted to yield a decantate which is discarded and recovered oil. The first recovered fuel stream from the first separation step is blended with the recovered oil separated from the concentrated sludge filtrate in order to form a semi-cleaned fuel stream. This semi-cleaned fuel stream is then subjected to the second separation step.

The process in accordance with the invention is applicable to the separation of water and large amounts of small particles from a fuel oil feedstock. In particular, the process is especially suitable for separating water and shale fines from shale oil. However, it is to be understood that the process is also applicable to use with other raw materials such as, for example, coal, bituminous sand and the like. Minor alterations in the process may be required depending on the characteristics of the raw materials used and such alterations are obvious to those of ordinary skill in the art.

As used herein, the term "small particles" refers generally to particles having diameters in the range between about 0 and 2 mm.

Referring to FIG. 1, a water and oil-containing fuel feedstock 1, hereinafter referred to as "dirty oil", is fed into a homogenizing tank 2. Dirty oil 1 from homogenizing tank 2 is heated in a heater 3 and fed to a first separation step. Dirty oil 1 is treated in a scroll type centrifugal decanter 4 in order to carry out the first separation step resulting in an oil cake 5 which is fed to a mixing tank 20 and a first recovered fuel stream which is collected in a tank 7.

Oil cake 5 contains more than 80% of the solids that were present in dirty oil feedstock 1 in concentrated form. Generally, oil cake 5 contains about 28% by weight of oil, about 6% by weight of water and about 66% by weight of solids. First recovered fuel stream 6 has a solids content of less than about 3% by weight.

Oil cake 5 in mixing tank 20 is mixed with a solvent 19 to remove residual oil in cake 5. In a preferred embodiment of the invention, solvent 19 is selected from a light fraction of the oil recovered from the process. A suspension 21 is removed from mixing tank 20 and mixed with a concentrated sludge 17 recycled from a separating vessel 16. First recovered fuel stream 6 in tank 7 is mixed with a recovered oil 28 removed from a filter-press 23. This yields a mixed stream 8 which is directed to a second separation step.

In the second separation step, the solids content remaining in mixed oil stream 8 is important. The degree of abrasiveness of a feedstock is directly related to the solids content and to the degree of wear shown by the internal parts of a centrifuge. Since the feedstock comes into contact with the internal parts of the centrifuge at high rotational speeds, it is desirable for the solids content of the oil to be as low as possible in order to ensure long life of the internal parts.

The second separation is effected in two steps. The first step is carried out in a continuous discharge centrifugal disc separator 9. The second step is performed in filter-press 23. To ensure good performance of disc centrifuge 9 used in the second separation, mixed stream 8 is passed through a filter 10 before it is fed to disc centrifuge 9. Coarser solid particles are retained by filter 10, thus yielding a semi-clean oil stream 11 that is supplied to centrifuge 9 for separation into three discrete streams by disc centrifuge 9. The first is clean oil stream 12, the second is an oil-bearing water stream 13 and the third is a sludge 14.

Clean oil stream 12 is cooled in a cooler 15 and fed to a storage area (not shown). Alternatively, clean oil stream 12 can be utilized as a fuel directly. The approximate composition of clean oil stream 12 is greater than about 99% by weight oil, less than about 0.5% by weight water and less than about 0.5% by weight solids. Accordingly, clean oil stream 12 meets the necessary specifications for marketing or further processing as a fuel oil.

Oil-bearing water stream 13 is supplied to a conventional water-oil separating system in order to obtain recovered oil and recovered water. The recovered oil can be incorporated into the feed to centrifugal decanter 4 used in the first separation step. A portion of the recovered water can be recirculated and used as sealing water for centrifuge 9 in the second separation.

Sludge stream 14 is fed to separating vessel 16 where it is concentrated. The sludge stream is concentrated and supernatant oil 29 is returned to centrifugal disc separator 9 to form a concentrated sludge stream 17. The final composition of concentrated sludge stream 17 is approximately 15% by weight oil, 75% by weight water and 10% by weight solids. From separating vessel 16, concentrated sludge 17 is pumped to a storage tank 18 where it is mixed with suspension 21 removed from mixing tank 20.

Suspension 21 is formed by treating oil cake 5 removed from the first separation in scroll-type separation 4 with solvent 19 for removal of oil by extraction. In a preferred embodiment, solvent 19 may be selected from a light fraction of processed oil which is recycled. When oil cake 5 is mixed with solvent 19 in mixing tank 20, suspension 21 is formed. Suspension 21 is mixed with concentrated sludge 17 in storage tank 18 to yield a mixture stream 22.

Mixture stream 22 from the mixture of suspension 21 and concentrated sludge 17 is fed to filter-press 23. A filtrate 24 of oil, solvent, traces of solids and water and a reject cake 25 are removed from filter-press 23. Reject cake 25 is a final reject waste product and has an approximate composition of less than about 16% by weight of oil, less than about 5% by weight of water and greater than about 79% by weight of solids. Accordingly, reject cake 25 can be disposed of easily.

Filtrate 24 removed from filter-press 23 is primarily water and a supernatant oil and is fed to a decanter 26. When filtrate 24 is decanted, a decantate 27, which is mainly water, and a supernatant oil 28 are removed. Decantate 27 is discarded. A portion of supernatant oil 28 is blended with first recovered fuel stream 6 from the first separation in mixing tank 7. Alternatively, supernatant oil 28 can be blended directly with clean oil 12 removed from centrifugal disc separator 9. The remaining portion of recovered oil 28 is mixed with clean oil 12 removed from disc separator 9 and removed from the process as product.

Optionally, the filter press plates used in filter-press 23 can be heated for the purpose of maximizing oil extraction. In addition, reject cake 25 can be washed with a suitable solvent and stream can be blown through reject cake 25 at the end of each operating cycle of filter-press 23. Suitable solvents for washing reject cake 25 include, but are not limited to, aromatic hydrocarbons such as naphtha.

It may be convenient to recycle filtrate 24 to disc centrifuge 9 in order to take advantage of the reduction in viscosity and density of first recovered oil fuel stream 6 removed from the first separation. These and other minor alterations in the process of the invention will be obvious to those skilled in the art.

The following examples are presented for purposes of illustration only and will permit in-depth evaluation of the efficiency of the process of the invention. The examples are not to be construed in a limiting sense and, as stated hereinabove, may be used with raw materials other than those shown in the Examples.

EXAMPLE 1

A shale oil feedstock obtained from a shale retort process was homogenized and heated to about 90° C. in preparation for treatment of the feedstock and separation of the water and solids in accordance with the invention.

The average composition of various streams in the process are set forth in Table 1.

TABLE I

| | First Separation | | | Second Separation | | |
|---|---|---|---|---|---|---|
| | Feed (1) | Oil Cake (5) | Recovered Oil (6) | Clean Oil (12) | Oil-Bearing Water (13) | Reject (25) |
| Oil (weight %) | 78.31 | 27.80 | 87.49 | 99.11 | 14.97 | 15.82 |
| Water (wt %) | 9.81 | 6.00 | 10.51 | 0.85 | 83.99 | 5.01 |
| Solids (wt %) | 11.88 | 66.20 | 2.00 | 0.04 | 1.03 | 79.16 |
| Temperature, °C. | 90 | 85 | 85 | 40 | 90 | 95 |
| Density ($t/m^3$) | 0.976 | 1.480 | 0.925 | 0.914 | 0.965 | 1.390 |
| Viscosity ($m^2/s \cdot 10^6$) | 1.8 | — | 2.9 | 3.1 | 0.5 | — |

The density and viscosity values were measured at operating temperature. The composition and physical properties of feedstock 1 charged to scroll type centrifugal decanter 4 are shown in column 1 of the Table. Oil cake 5 and recovered oil 6 obtained from the first separation are described in columns 2 and 3, respectively. The composition and properties of clean oil 12, oil-bearing water stream 13 and final reject cake 25 are shown at columns 4, 5 and 6, respectively.

EXAMPLE 2

In this example, measurements were conducted as in Example 1, except that feedstock 1 contained a higher solids content. The results achieved are shown in Table II.

TABLE II

| | First Separation | | | Second Separation | | |
|---|---|---|---|---|---|---|
| | Feed (1) | Oil Cake (5) | Recovered Oil (6) | Clean Oil (12) | Oil-bearing Water (13) | Reject (25) |
| Oil (wt %) | 73.92 | 27.80 | 87.75 | 99.11 | 14.97 | 15.84 |
| Water (wt %) | 9.26 | 6.0 | 10.24 | 0.85 | 83.99 | 5.00 |
| Solids (wt %) | 16.82 | 66.20 | 2.00 | 0.04 | 1.03 | 79.16 |
| Temperature, °C. | 90 | 85 | 85 | 40 | 90 | 95 |
| Density ($t/m^3$) | 1.007 | 1.480 | 0.924 | 0.914 | 0.965 | 1.390 |
| Viscosity ($m^2/s \cdot 10^6$) | 2.8 | — | 2.9 | 3.1 | 0.5 | — |

As can be seen from Tables I and II, the invention is useful for recovering oil from a fuel oil feedstock containing a large amount of water and insoluble solids. The resulting clean oil has a purity greater than about 99% oil and is suitable for use as a fuel.

It will thus be seen that the objects set forth above, among those made apparent from the preceding description, are efficiently attained and, since certain changes may be made in carrying out the above process without departing from the spirit and scope of the invention, it is intended that all matter contained in the above description shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A process for separating water and solid particles from a fuel oil feedstock comprising:

subjecting the feedstock to a first separation in a scroll type centrifugal separator to form a first recovered fuel stream and an oil cake;

subjecting at least the first recovered fuel stream to a second separation in a centrifugal disc separator to form a clean fuel stream, an oil-bearing water stream and a sludge stream;

treating the oil-bearing water stream in a separator to recover the oil;

treating the oil cake removed from the first separation with a solvent in order to form a suspension;

mixing the suspension with the sludge stream to form a mixture;

feeding the mixture to a filter press to yield a solid reject and a filtrate;

separating the filtrate into a decantate and recovered oil;

mixing at least a portion of the recovered oil with first recovered fuel stream to form a semi-cleaned fuel stream; and subjecting the semi-cleaned fuel stream to the second separation in a centrifugal disc separator to form said clean fuel stream.

2. The process of claim 1, wherein all of the recovered oil is mixed with the first recovered fuel stream.

3. The process of claim 1, wherein the solvent used to treat the oil cake obtained in the first separation step is a light fraction of oil.

4. The process of claim 3, wherein the light fraction of oil is recycled from the clean fuel stream removed from the second separation.

5. The process of claim 1, wherein the solid particle content of the fuel oil feedstock is between about 5 and 21% by weight; and the solids content of the first recovered fuel stream is less than about 3% by weight.

6. The process of claim 5, wherein the solids content of the clean fuel stream is less than about 0.5% by weight.

7. The process of claim 1, wherein the fuel oil feedstock is homogenized and heated prior to being subjected to the first separation.

8. The process of claim 1, wherein the semi-cleaned fuel stream is filtered prior to being subjected to the second separation.

9. The process of claim 1, wherein the sludge stream obtained in the second separation is fed to a separating vessel and separated into a supernatant oil and a concentrated sludge stream and the concentrated sludge stream is mixed with the suspension.

10. The process of claim 9, wherein the supernatant oil removed from the separating vessel is recycled to the second separation.

11. The process of claim 1, wherein the filtrate removed from the filter press is fed to the second separation.

12. The process of claim 1, wherein the recovered oil removed from the filtrate is sufficiently clean to be used directly as a fuel.

13. A process for separating water and solid particles from a fuel oil feedstock having a solids content between about 5 and 21% by weight comprising:

homogenizing and heating the feedstock;

subjecting the homogenized heated feedstock to a first separation in a scroll type centrifugal separator to form a first recovered fuel stream having a solids content of less than about 3% by weight and an oil cake;

subjecting at least the first recovered fuel stream to a second separation in a centrifugal disc separator with a continuous discharge to form a clean fuel stream, an oil-bearing water stream and a sludge stream;

treating the oil cake removed from the first separation with a light fraction of oil in order to form a suspension;

feeding the sludge stream to a separating vessel;

separating the sludge stream into a supernatant oil and a concentrated sludge stream;

mixing the suspension with the concentrated sludge stream to form a mixture;

feeding the mixture to a filter press to yield a solid reject and a filtrate;

separating the filtrate into a decantate and recovered oil;

mixing at least a portion of the recovered oil with first recovered fuel stream to form a semi-cleaned fuel stream;

filtering the semi-cleaned fuel stream;

subjecting the filtered semi-cleaned fuel stream to the second separation in a centrifugal disc separator to form said clean fuel stream; and recycling the supernatant oil removed from the separating vessel to the second separation.

* * * * *